US008357478B2

(12) United States Patent
Katsuhara et al.

(10) Patent No.: US 8,357,478 B2
(45) Date of Patent: Jan. 22, 2013

(54) ELECTROPHOTOGRAPHIC PHOTOCONDUCTOR, PROCESS CARTRIDGE, AND IMAGE FORMING APPARATUS

(75) Inventors: Hideya Katsuhara, Kanagawa (JP); Shigeru Yagi, Kanagawa (JP); Takashi Imai, Kanagawa (JP); Nobuyuki Torigoe, Kanagawa (JP); Takeshi Iwanaga, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 224 days.

(21) Appl. No.: 12/869,304

(22) Filed: Aug. 26, 2010

(65) Prior Publication Data

US 2011/0229810 A1 Sep. 22, 2011

(30) Foreign Application Priority Data

Mar. 19, 2010 (JP) ..... 2010-064557

(51) Int. Cl.
*G03G 5/00* (2006.01)

(52) U.S. Cl. ..... 430/66; 399/159

(58) Field of Classification Search ..... 430/66; 399/159

See application file for complete search history.

(56) References Cited

U.S. PATENT DOCUMENTS 4,848,141 A 7/1989 Oliver et al.
7,678,519 B2 3/2010 Iwanaga et al.
7,759,033 B2 7/2010 Yagi

*Primary Examiner* — Mark A Chapman
(74) *Attorney, Agent, or Firm* — Oliff & Berridge, PLC

(57) ABSTRACT

An electrophotographic photoconductor includes a base, a photosensitive layer formed on the base, and an overcoat layer formed on the photosensitive layer, wherein the overcoat layer includes gallium, oxygen, and hydrogen, and the intensity ratio ($I_{O-H}/I_{Ga-O}$) of a signal $I_{O-H}$ of an O—H bond to a signal $I_{Ga-O}$ of a Ga—O bond in an infrared absorption spectrum is about 0.1 or more and 0.5 or less.

18 Claims, 6 Drawing Sheets

ELECTROPHOTOGRAPHIC PHOTOCONDUCTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-064557 filed Mar. 19, 2010.

BACKGROUND (i) Technical Field

The present invention relates to an electrophotographic photoconductor, a process cartridge, and an image forming apparatus.

(ii) Related Art

Electrophotography is widely used for copiers, printers, and the like.

In recent years, there has been considered a technique in which a surface layer (overcoat layer) is formed on the surface of an photosensitive layer of an electrophotographic photoconductor (hereinafter may be referred to as "photoconductor") used for an image forming apparatus that utilizes electrophotography.

SUMMARY

According to an aspect of the invention, there is provided an electrophotographic photoconductor including a base; a photosensitive layer formed on the base; and an overcoat layer formed on the photosensitive layer, wherein the overcoat layer includes gallium, oxygen, and hydrogen, and the intensity ratio ($I_{O-H}/I_{Ga-O}$) of a signal $I_{O-H}$ of an O—H bond to a signal $I_{Ga-O}$ of a Ga—O bond in an infrared absorption spectrum is about 0.1 or more and 0.5 or less.

BRIEF DESCRIPTION OF THE DRAWINGS

Exemplary embodiments of the present invention will be described in detail based on the following figures, wherein.

DETAILED DESCRIPTION

Figure 1:
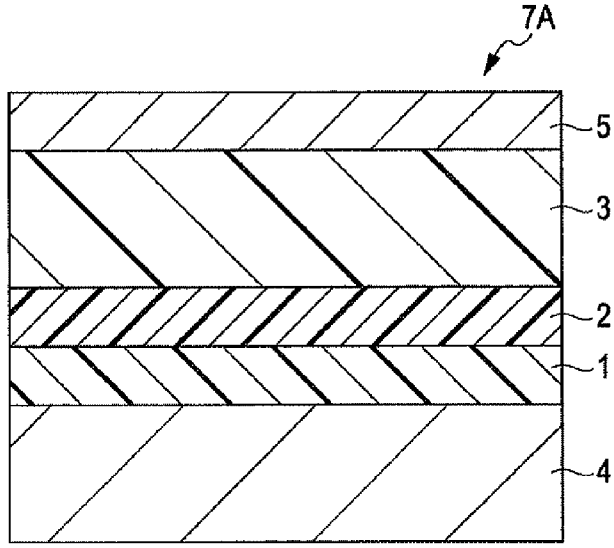
FIG. 1 is a schematic sectional view showing an example of a layer structure of an electrophotographic photoconductor according to this exemplary embodiment.

An exemplary embodiment of the invention will now be described in detail.

Electrophotographic Photoconductor

An electrophotographic photoconductor according to this exemplary embodiment includes a base, a photosensitive layer formed on the base, and an overcoat layer formed on the photosensitive layer. The overcoat layer includes gallium, oxygen, and hydrogen, and the intensity ratio ($I_{O-H}/I_{Ga-O}$) of a signal $I_{O-H}$ of an O—H bond to a signal $I_{Ga-O}$ of a Ga—O bond in an infrared absorption spectrum is 0.1 or more and 0.5 or less or about 0.1 or more and 0.5 or less.

In the electrophotographic photoconductor according to this exemplary embodiment, the occurrence of cracks and dents of the overcoat layer is suppressed.

Herein, the intensity ratio ($I_{O-H}/I_{Ga-O}$) in the above-described range means that hydrogen atoms are contained in the form of an "O—H" bond in a layer containing gallium and oxygen, that is, a gallium oxide layer serving as the overcoat layer.

With hydrogen atoms contained in the form of the "O—H" bond, the gallium oxide layer has a low elastic modulus, that is, is imparted with flexibility. This may be because, if hydrogen atoms are contained in the form of the "O—H" bond, the flexibility between atomic bonds of the gallium oxide layer is improved.

Therefore, it is considered that, in the electrophotographic photoconductor according to this exemplary embodiment, the occurrence of cracks and dents of the overcoat layer is suppressed. Furthermore, since the flexibility is imparted to the overcoat layer composed of a gallium oxide layer, the thickness of the overcoat layer is increased (e.g., 2 μm or more or about 2 μm or more), which may further suppress the occurrence of dents of the overcoat layer. As a result, there are suppressed the occurrence of dents caused by foreign matter such as carriers caught in the overcoat layer of the electrophotographic photoconductor and the occurrence of dents (cracks) caused by an overload with a blade or the like.

In an image forming apparatus including the electrophotographic photoconductor according to this exemplary embodiment, there is provided an image in which an image defect (e.g., a decrease in image density) caused by the occurrence of dents of the overcoat layer of the electrophotographic photoconductor is suppressed.

In addition, by incorporating hydrogen atoms in the form of the "O—H" bond, the gallium oxide layer has conductivity even if the gallium oxide layer does not have a composition with an oxygen defect. This may be because the hydrogen atoms contained in the form of the "O—H" bond serve as a donor and thereby conductivity is provided.

Thus, the electrophotographic photoconductor according to this exemplary embodiment is a member having conductivity (e.g., about $10^7$ Ω·cm or more and $10^{13}$ Ω·cm or less) required for functioning as an electrophotographic photoconductor even if the overcoat layer does not have a composition with an oxygen defect. Such a film is transparent to ultraviolet light to near-infrared light having a wavelength of longer than about 350 nm, and the sensitivity is not decreased when the thickness is increased, as in the case of Japanese Unexamined Patent Application Publication No. 2008-268266.

The gallium oxide layer whose conductivity is provided using a composition with an oxygen defect is normally formed by a film formation method such as plasma chemical vapor deposition (CVD). However, in this film formation, film growth needs to be performed in an atmosphere in which a gallium (Ga) material is present in an excessively larger amount than that of an oxygen (O) material. Consequently, the reaction rate tends to be decreased compared with the case where film growth is performed in an atmosphere in which an oxygen (O) material is present in an excessively larger amount.

In contrast, in the gallium oxide layer whose conductivity is provided by incorporating hydrogen atoms in the form of the "O—H" bond as in this exemplary embodiment, film growth is not necessarily performed in an atmosphere in which a gallium (Ga) material is present in an excessively larger amount than that of an oxygen (O) material. Such a gallium oxide layer is favorable in terms of cost and productivity compared with the gallium oxide layer whose conductivity is provided using a composition with an oxygen defect.

Obviously, the electrophotographic photoconductor according to this exemplary embodiment is also excellent in terms of durability because the overcoat layer includes gallium, oxygen, and hydrogen.

The electrophotographic photoconductor according to this exemplary embodiment will now be described in detail with reference to the attached drawings. In the drawings, the same or corresponding parts are designated by the same reference numerals, and redundant descriptions are omitted.

Figure 2:
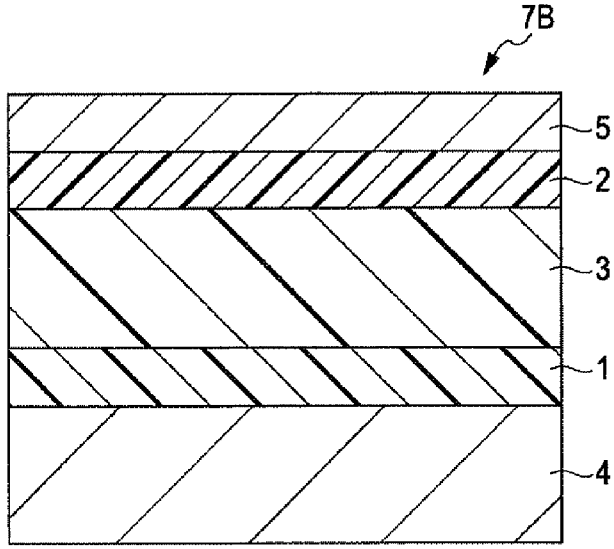
FIG. 2 is a schematic sectional view showing another example of a layer structure of an electrophotographic photoconductor according to this exemplary embodiment.
Figure 3:
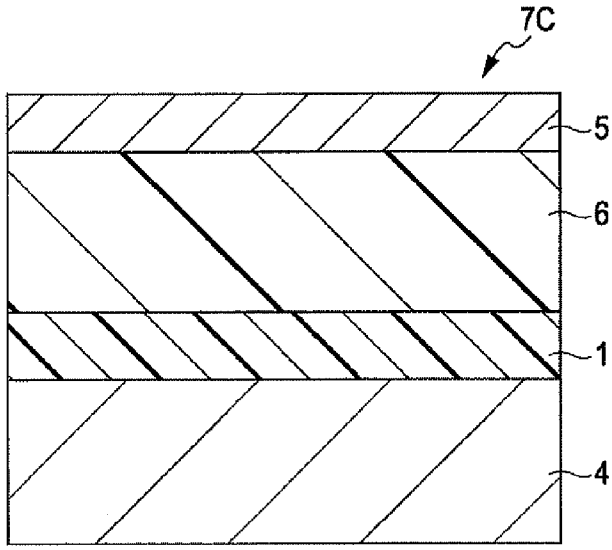
FIG. 3 is a schematic sectional view showing still another example of a layer structure of an electrophotographic photoconductor according to this exemplary embodiment.

FIG. 1 is a schematic sectional view showing an example of the electrophotographic photoconductor according to this exemplary embodiment. FIGS. 2 and 3 are schematic sectional views each showing another example of electrophotographic photoconductor according to this exemplary embodiment.

An electrophotographic photoconductor 7A shown in FIG. 1 is a so-called function-separated photoconductor (or multilayered photoconductor) and has a structure obtained by forming an undercoating layer 1 on a conductive base 4 and then by forming a charge generating layer 2, a charge transporting layer 3, and an overcoat layer 5 thereon in sequence. In the electrophotographic photoconductor 7A, the charge generating layer 2 and the charge transporting layer 3 constitute a photosensitive layer.

An electrophotographic photoconductor 7B shown in FIG. 2 is also a function-separated photoconductor in which functions are separately provided to a charge generating layer 2 and a charge transporting layer 3 as in the electrophotographic photoconductor 7A shown in FIG. 1. An electrophotographic photoconductor 7C shown in FIG. 3 contains a charge generating material and a charge transporting material in a single layer (single-layer type photosensitive layer 6 (charge generating/charge transporting layer)).

In the electrophotographic photoconductor 7B shown in FIG. 2, an undercoating layer 1 is formed on a conductive base 4, and a charge transporting layer 3, a charge generating layer 2, and an overcoat layer 5 are formed thereon in sequence. In the electrophotographic photoconductor 7B, the charge transporting layer 3 and the charge generating layer 2 constitute a photosensitive layer.

In the electrophotographic photoconductor 7C shown in FIG. 3, an undercoating layer 1 is formed on a conductive base 4, and a single-layer type photosensitive layer 6 and an overcoat layer 5 are formed thereon in sequence.

In the electrophotographic photoconductors shown in FIGS. 1 to 3, the undercoating layer 1 is not necessarily formed.

Hereinafter, each of the components will now be described based on the electrophotographic photoconductor 7A shown in FIG. 1 as a representative example.

Conductive Base

Any known conductive base may be used as the conductive base 4. Examples of the conductive base include plastic films having a thin film (e.g., a metal of aluminum, nickel, chromium, stainless steel, or the like or a film of aluminum, titanium, nickel, chromium, stainless steel, gold, vanadium, tin oxide, indium oxide, indium tin oxide (ITO), or the like), paper to which a conductivity-imparting agent is applied or paper impregnated with a conductivity-imparting agent, or plastic films to which a conductivity-imparting agent is applied or plastic films impregnated with a conductivity-imparting agent. The shape of the conductive base is not limited to a cylindrical shape, and a sheet shape or a plate shape may be used.

Conductive base particles suitably have conductivity of, for example, a volume resistivity of less than $10^7$ Ω·cm.

When a metal pipe is used as the conductive base, the surface of the metal pipe may remain unprocessed or may be subjected to mirror cutting, etching, anodic oxidation, rough cutting, centerless grinding, sandblasting, wet honing, or the like in advance.

Undercoating Layer

The undercoating layer is optionally formed in order to prevent light reflection on the surface of the conductive base and prevent undesired carriers from flowing into the photosensitive layer from the conductive base.

The undercoating layer contains, for example, a binder resin and optionally other additives.

Examples of the binder resin contained in the undercoating layer include publicly known polymer resin compounds such as acetal resins, for example, polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins; charge transporting resins having a charge transporting group; and conductive resins such as polyaniline. Among these resins, resins that are insoluble in a coating solvent of an upper layer are suitably used. In particular, phenol resins, phenol-formaldehyde resins, melamine resins, urethane resins, and epoxy resins are suitably used.

The undercoating layer may contain a metal compound such as a silicone compound, an organic zirconium compound, an organic titanium compound, or an organic aluminum compound.

The ratio of the metal compound to the binder resin is not particularly limited, and any ratio may be set as long as desired characteristics of electrophotographic photoconductors are achieved.

Resin particles may be added to the undercoating layer to adjust surface roughness. Examples of the resin particles include silicone resin particles and cross-linked polymethyl methacrylate (PMMA) resin particles. To adjust surface roughness, after the undercoating layer is formed, the surface of the undercoating layer may be polished. The polishing is performed by buffing, sandblasting, wet honing, or grinding.

Herein, the undercoating layer is, for example, composed of at least the binder resin and the conductive particles. Conductive particles suitably have conductivity of, for example, a volume resistivity of less than $10^7$ Ω·cm.

Examples of the conductive particles include metal particles (particles of aluminum, copper, nickel, silver, or the like), conductive metal oxide particles (particles of antimony oxide, indium oxide, tin oxide, zinc oxide, or the like), and conductive substance particles (particles of carbon fiber, carbon black, or graphite powder). Among these conductive particles, conductive metal oxide particles are suitably used. The conductive particles may be used in combination.

The conductive particles may be subjected to surface treatment with a hydrophobizing agent (e.g., coupling agent) to adjust the resistance.

The content of the conductive particles is, for example, preferably 10% or more and 80% or less and more preferably 40% or more and 80% or less by mass relative to the binder resin.

In the formation of the undercoating layer, a coating solution for forming the undercoating layer obtained by adding the above-described components to a solvent is used.

Particles are dispersed in the coating solution for forming the undercoating layer using a media dispersing machine such as a ball mill, a vibrating ball mill, an attritor, a sand mill, or a horizontal sand mill or a medialess dispersing machine such as a stirrer, an ultrasonic dispersing machine, a roll mill, or a high-pressure homogenizer. Herein, high-pressure homogenizers include a collision-type homogenizer that disperses dispersion liquid through liquid-liquid collision or liquid-wall collision under high pressure and a penetration-type homogenizer that disperses dispersion liquid by forcing the liquid through a fine channel under high pressure.

The coating solution for forming the undercoating layer is applied on the conductive base by dip coating, ring coating, wire bar coating, spray coating, blade coating, knife coating, curtain coating, or the like.

The thickness of the undercoating layer is preferably 15 μm or more and more preferably 20 μm or more and 50 μm or less.

An intermediate layer (not shown) may be formed between the undercoating layer and the photosensitive layer. Examples of the binder resin used for the intermediate layer include polymer resin compounds such as acetal resins, for example, polyvinyl butyral, polyvinyl alcohol resins, casein, polyimide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins; and organic metal compounds containing zirconium, titanium, aluminum, manganese, or silicon. These compounds may be used alone or in the form of a mixture or a polycondensate of plural compounds. Among these compounds, an organic metal compound containing zirconium or silicon is suitable because the rest potential is low, the change in potential due to an environment is small, and the change in potential due to repeated usage is small.

In the formation of the intermediate layer, a coating solution for forming the intermediate layer obtained by adding the above-described components to a solvent is used.

The coating solution for forming the intermediate layer is applied by a typical method such as dip coating, ring coating, wire bar coating, spray coating, blade coating, knife coating, or curtain coating.

The intermediate layer improves ease of coating of an upper layer and also functions as an electrical blocking layer. However, if the thickness is excessively large, an electric barrier becomes excessively strong, which may cause desensitization or an increase in potential due to repeated usage. Thus, in the case where an intermediate layer is formed, the thickness is suitably set to 0.1 μm or more and 3 μm or less. In this case, the intermediate layer may be used as the undercoating layer.

Charge Generating Layer

The charge generating layer is composed of, for example, a charge generating material and a binder resin. Examples of the charge generating material include phthalocyanine pigments such as metal-free phthalocyanine, chlorogallium phthalocyanine, hydroxygallium phthalocyanine, dichlorotin phthalocyanine, and titanyl phthalocyanine. In particular, there are exemplified a chlorogallium phthalocyanine crystal having strong diffraction peaks at least at Bragg angles (2θ±0.2°) of 7.4°, 16.6°, 25.5°, and 28.3° in the X-ray diffraction spectrum measured using a CuKα characteristic X-ray, a metal-free phthalocyanine crystal having strong diffraction peaks at least at Bragg angles (2θ±0.2°) of 7.7°, 9.3°, 16.9°, 17.5°, 22.4°, and 28.8° in the X-ray diffraction spectrum measured using a CuKα characteristic X-ray, a hydroxygallium phthalocyanine crystal having strong diffraction peaks at least at Bragg angles (2θ±0.2°) of 7.5°, 9.9°, 12.5°, 16.3°, 18.6°, 25.1°, and 28.3° in the X-ray diffraction spectrum measured using a CuKα characteristic X-ray, and a titanyl phthalocyanine crystal having strong diffraction peaks at least at Bragg angles (2θ±0.2°) of 9.6°, 24.1°, and 27.2° in the X-ray diffraction spectrum measured using a CuKα characteristic X-ray. Other examples of the charge generating material include quinone pigments, perylene pigments, indigo pigments, bisbenzimidazole pigments, anthrone pigments, and quinacridone pigments. These charge generating materials may be used alone or in combination.

Examples of the binder resin constituting the charge generating layer include bisphenol A or bisphenol Z polycarbonate resins, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinylcarbazole resins. These binder resins may be used alone or in combination.

The compounding ratio of the charge generating material to the binder resin is desirably, for example, 10:1 to 1:10.

In the formation of the charge generating layer, a coating solution for forming the charge generating layer obtained by adding the above-described components to a solvent is used.

Particles (e.g., charge generating material) are dispersed in the coating solution for forming the charge generating layer using a media dispersing machine such as a ball mill, a vibrating ball mill, an attritor, a sand mill, or a horizontal sand mill or a medialess dispersing machine such as a stirrer, an ultrasonic dispersing machine, a roll mill, or a high-pressure homogenizer. High-pressure homogenizers include a collision-type homogenizer that disperses dispersion liquid through liquid-liquid collision or liquid-wall collision under high pressure and a penetration-type homogenizer that disperses dispersion liquid by forcing the liquid through a fine channel under high pressure.

The coating solution for forming the charge generating layer is applied on the undercoating layer by dip coating, ring coating, wire bar coating, spray coating, blade coating, knife coating, curtain coating, or the like.

The thickness of the charge generating layer is preferably 0.01 μm or more and 5 μm or less and more preferably 0.05 μm or more and 2.0 μm or less.

Charge Transporting Layer

The charge transporting layer is composed of a charge transporting material and optionally a binder resin.

Examples of the charge transporting material include hole transporting materials including oxadiazole derivatives such as 2,5-bis(p-diethylaminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylaminostyryl)pyrazoline, aromatic tertiary amino compounds such as triphenylamine, N,N'-bis(3,4-dimethylphenyl)biphenyl-4-amine, tri(p-methylphenyl)aminyl-4-amine, and dibenzylaniline, aromatic tertiary diamino compounds such as N,N'-bis(3-methylphenyl)-N,N'-diphenylbenzidine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehyde-1,1-diphenylhydrazone, quinazoline derivatives such as 2-phenyl-4-styryl-quinazoline, benzofuran derivatives such as 6-hydroxy-2,3-di(p-methoxyphenyl)benzofuran, α-stilbene derivatives such as p-(2,2-diphenylvinyl)-N,N-diphenylaniline, enamine derivatives, carbazole derivatives such as N-ethylcarbazole, and poly-N-vinylcarbazole and the derivatives thereof; electron transporting materials including quinone compounds such as chloranil and bromoanthraquinone, tetracyanoquinodimethane compounds, fluorenone compounds such as 2,4,7-trinitrofluorenone and 2,4,5,7-tetranitro-9-fluorenone, xanthone compounds, and thiophene compounds; and polymers having a group composed of the above-described compounds as the main chain or side chain thereof. These charge transporting materials may be used alone or in combination.

Examples of the binder resin constituting the charge transporting layer include bisphenol A or bisphenol Z polycarbonate resins, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, insulating resins such as chlorine rubber, and organic photoconductive polymers such as polyvinyl carbazole, polyvinyl anthracene, and polyvinyl pyrene. These binder resins may be used alone or in combination.

The compounding ratio of the charge transporting material to the binder resin is desirably, for example, 10:1 to 1:5.

The charge transporting layer is formed with a coating solution for forming the charge transporting layer obtained by adding the above-described components to a solvent.

Particles (e.g., fluorocarbon resin particles) are dispersed in the coating solution for forming the charge transporting layer using a media dispersing machine such as a ball mill, a vibrating ball mill, an attritor, a sand mill, or a horizontal sand mill or a medialess dispersing machine such as a stirrer, an ultrasonic dispersing machine, a roll mill, or a high-pressure homogenizer. High-pressure homogenizers include a collision-type homogenizer that disperses dispersion liquid through liquid-liquid collision or liquid-wall collision under high pressure and a penetration-type homogenizer that disperses dispersion liquid by forcing the liquid through a fine channel under high pressure.

The coating solution for forming the charge transporting layer is applied on the charge generating layer by a typical method such as dip coating, ring coating, wire bar coating, spray coating, blade coating, knife coating, or curtain coating.

The thickness of the charge transporting layer is preferably 5 μm or more and 50 μm or less and more preferably 10 μm or more and 40 μm or less.

Overcoat Layer

The overcoat layer includes gallium, oxygen, and hydrogen, and the intensity ratio ($I_{O-H}/I_{Ga-O}$) of a signal $I_{O-H}$ of an O—H bond to a signal $I_{Ga-O}$ of a Ga—O bond in an infrared absorption spectrum is 0.1 or more and 0.5 or less or about 0.1 or more and 0.5 or less, preferably 0.15 or more and 0.35 or less or about 0.15 or more and 0.35 or less, and more preferably 0.20 or more and 0.30 or less or about 0.20 or more and 0.30 or less.

By setting the intensity ratio ($I_{O-H}/I_{Ga-O}$) in the above-described range, the occurrence of cracks of the overcoat layer is suppressed.

Figure 8:
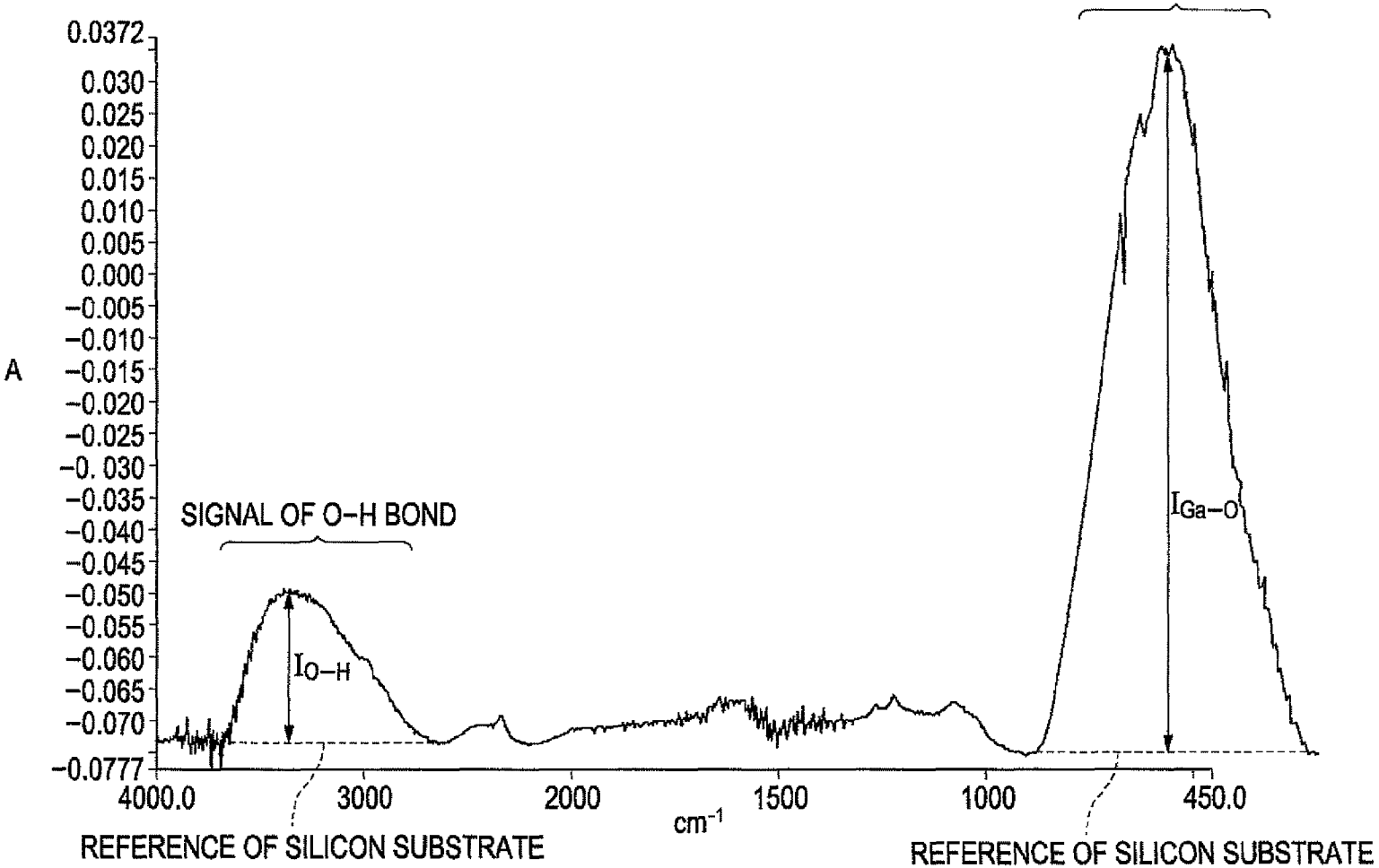
FIG. 8 shows an example of an infrared absorption spectrum of the overcoat layer of the electrophotographic photoconductor according to this exemplary embodiment.

In an infrared absorption spectrum, the signal $I_{Ga-O}$ of a Ga—O bond appears, for example, in the range between 300 $cm^{-1}$ and 800 $cm^{-1}$ (the peak is around 500 $cm^{-1}$). The signal $I_{O-H}$ of an O—H bond appears, for example, in the range between 2600 $cm^{-1}$ and 3800 $cm^{-1}$ (refer to FIG. 8).

The intensity ratio ($I_{O-H}/I_{Ga-O}$) is obtained by measuring the infrared absorption spectrum (e.g., infrared absorption spectrum shown in FIG. 8) of the overcoat layer and calculating the intensity of each signal in the measured infrared absorption spectrum.

Specifically, a sample of the overcoat layer is formed on a silicon substrate, which is used as a reference. Signals are obtained by measuring the infrared absorption spectrum, and the intensity of each of the signals is obtained as a difference from the reference. Furthermore, the fluctuation in background due to interference is calculated through baseline processing to obtain the intensity ratio ($I_{O-H}/I_{Ga-O}$).

Herein, the infrared absorption spectrum is measured with Spectrum One FT-IR Spectrometer (available from PerkinElmer) using the transmission mode. Alternatively, in the measurement of the infrared absorption spectrum, the photoconductor itself as a sample is measured from the surface layer side by a reflection absorption method (RA method), an attenuated total reflectance method (ATR method), or the like, and signals from the surface layer are determined through the subtraction of signals from the substrate.

The intensity ratio ($I_{O-H}/I_{Ga-O}$) is set in the above-described range by changing the pressure during the formation of the overcoat layer (e.g., by increasing the pressure), which is described later.

The overcoat layer includes gallium, oxygen, and hydrogen. The component ratio of gallium to all constituent elements in the overcoat layer is, for example, 15 atom % or more and 50 atom % or less or about 15 atom % or more and 50 atom % or less, preferably 20 atom % or more and 40 atom % or less, and more preferably 20 atom % or more and 30 atom % or less.

The component ratio of oxygen to all constituent elements in the overcoat layer is, for example, 30 atom % or more and 70 atom % or less, preferably 40 atom % or more and 60 atom % or less, and more preferably 45 atom % or more and 55 atom % or less.

The component ratio of hydrogen to all constituent elements in the overcoat layer is, for example, 10 atom % or more and 40 atom % or less or about 10 atom % or more and 40 atom % or less, preferably 15 atom % or more and 35 atom % or less, and more preferably 20 atom % or more and 30 atom % or less.

The atomic ratio of oxygen to gallium is more than 1.50 and 2.20 or less or about more than 1.50 and 2.20 or less, and preferably more than 1.6 and 2.0 or less or about more than 1.6 and 2.0 or less. By setting the atomic ratio of oxygen to gallium in the above-described range, the occurrence of dents of the overcoat layer is easily suppressed.

The component ratio of each element and the atomic ratio of oxygen to gallium are measured by Rutherford backscattering spectrometry (RBS) using the following apparatuses.

Accelerator: 3SDH Pelletron available from NEC Corporation

End station: RBS-400 available from CE & A Co. Pty. Ltd.

System: 3S-R10

The analysis is performed using HYPRA program available from CE & A Co. Pty. Ltd.

The measurement conditions of RBS are as follows.

He++ ion beam energy: 2.275 eV

Detection angle: 160° (the grazing angle of incident beams is about)109°)

In the RBS measurement, He++ ion beams are incident upon a sample in a direction perpendicular to the sample and a detector is set at 160° relative to the ion beams to measure the signals of backscattered He++ ions. The composition ratio and the thickness are determined in accordance with the energy and intensity of He detected.

The overcoat layer is desirably a non-single crystal film such as a microcrystal film, a polycrystalline film, or an amorphous film. Among these films, an amorphous film is particularly preferable in terms of surface smoothness, but a microcrystal film is more preferable in terms of hardness.

The growth section of the overcoat layer may have a column shape, but a flat structure is desired in terms of sliding properties and thus an amorphous film is suitable.

For example, in the case of an n-type, the overcoat layer may contain at least one element selected from C, Si, Ge, and Sn to control a conductivity type. In the case of a p-type, the overcoat layer may contain at least one element selected from N, Be, Mg, Ca, and Sr.

The thickness of the overcoat layer is suitably, for example, 0.05 μm or more. However, since the overcoat layer is flexible, the thickness may be increased while the occurrence of dents, cracks, and flaking is suppressed. Thus, the thickness of the overcoat layer is preferably 2.0 μm or more or about 2.0 μm or more, and more preferably 3.0 μm or more. The thickness of the overcoat layer is suitably 10.0 μm or less.

The elastic modulus of the overcoat layer is 30 GPa or more and 80 GPa or less and preferably 40 GPa or more and 65 GPa or less.

By setting the elastic modulus in the above-described range, the occurrence of dents, cracks, and flaking of the overcoat layer is suppressed. The above-described range of the elastic modulus is achieved by setting the intensity ratio in the above-described range.

The depth profile is obtained by continuous stiffness measurement (CSM) (US Patent No. 4848141) using Nano Indenter SA2 available from MTS Systems Corporation. The elastic modulus is an average value of the measured values at an indentation depth of 30 to 100 nm. The measurement conditions are as follows.

Measurement environment: 23° C., 55% RH

Indenter used: diamond triangular pyramid indenter (Berkovic indenter)

Test mode: CSM mode

A method for forming the overcoat layer will now be described.

Method for Forming Overcoat Layer

Next, a method for forming the overcoat layer will be specifically described. The overcoat layer is formed by a publicly known vapor phase film formation method such as plasma CVD, metal-organic chemical vapor deposition, molecular beam epitaxy, or sputtering.

Hereinafter, a specific example of an apparatus used for forming the overcoat layer will be described with reference to the drawings.

The overcoat layer is formed by a publicly known vapor phase film formation method such as plasma CVD, metal-organic chemical vapor deposition, molecular beam epitaxy, vapor deposition, or sputtering.

Figure 4A:
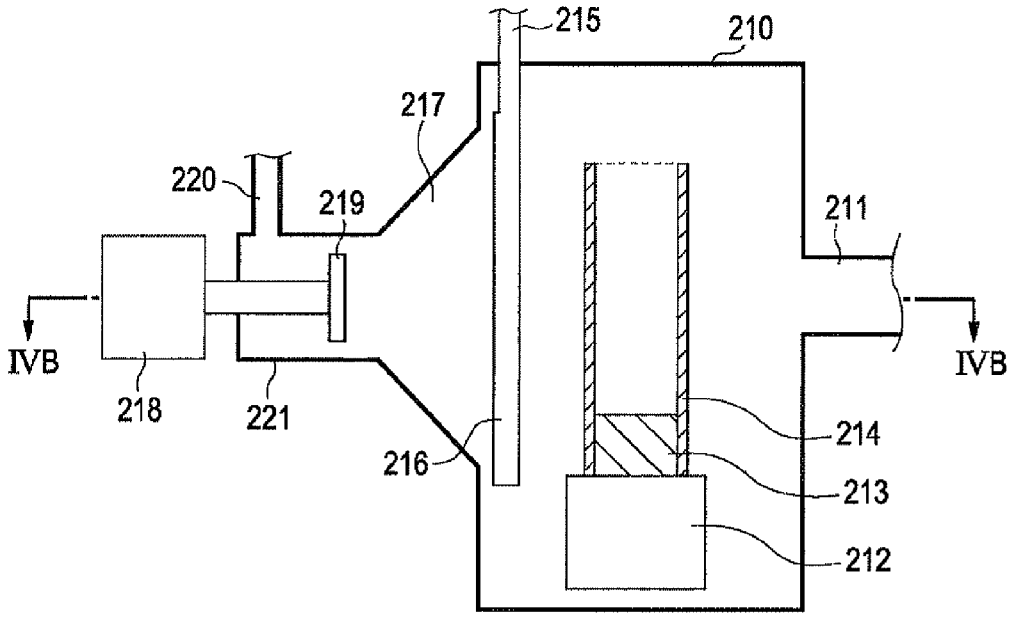
FIGS. 4A and 4B are schematic views showing an example of a film formation apparatus used for forming an overcoat layer of the electrophotographic photoconductor according to this exemplary embodiment.
Figure 4B:
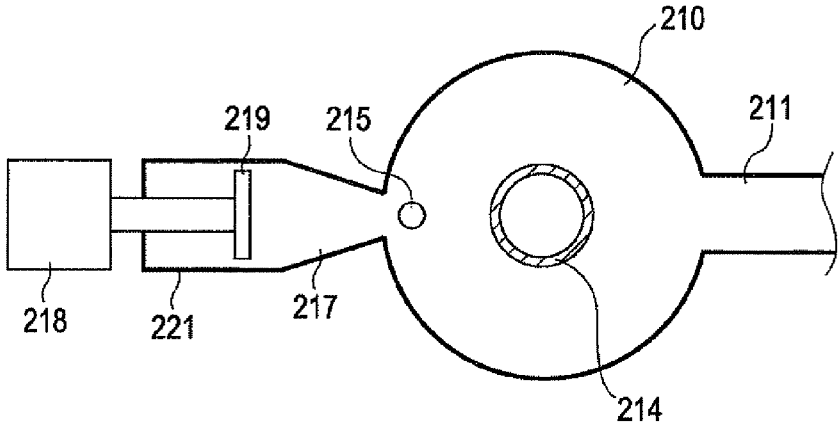

FIGS. 4A and 4B show an example of a film formation apparatus used for forming the overcoat layer of the electrophotographic photoconductor according to this exemplary embodiment. FIG. 4A is a schematic sectional view when the film formation apparatus is viewed from the side. FIG. 4B is a schematic sectional view taken along line IVB-IVB of the film formation apparatus shown in FIG. 4A. In FIGS. 4A and 4B, 210 denotes a film formation chamber, 211 denotes an outlet, 212 denotes a base rotation unit, 213 denotes a base-supporting member, 214 denotes a base, 215 denotes a gas-introducing pipe, 216 denotes a shower nozzle having openings through which gas introduced from the gas-introducing pipe 215 is ejected, 217 denotes a plasma-spreading portion, 218 denotes a high-frequency power supply unit, 219 denotes a plate electrode, 220 denotes a gas-introducing pipe, and 221 denotes a high-frequency discharge tube.

In the film formation apparatus shown in FIGS. 4A and 4B, the outlet 211 connected to an evacuator (not shown) is disposed at one end of the film formation chamber 210. A plasma generating device including the high-frequency power supply unit 218, the plate electrode 219, and the high-frequency discharge tube 221 is disposed at another end of the film formation chamber 210, the other end being opposite the end where the outlet 211 is disposed.

In the plasma generating device, the plate electrode 219 is disposed in the high-frequency discharge tube 221, the discharge surface of the plate electrode 219 being disposed on the outlet 211 side, and the high-frequency power supply unit 218 is disposed outside the high-frequency discharge tube 221, the high-frequency power supply unit 218 being connected to a surface of the plate electrode 219 opposite the discharge surface. The gas-introducing pipe 220 for supplying gas to the high-frequency discharge tube 221 has one end connected to the high-frequency discharge tube 221 and another end connected to a first gas supply source (not shown).

Figure 5:
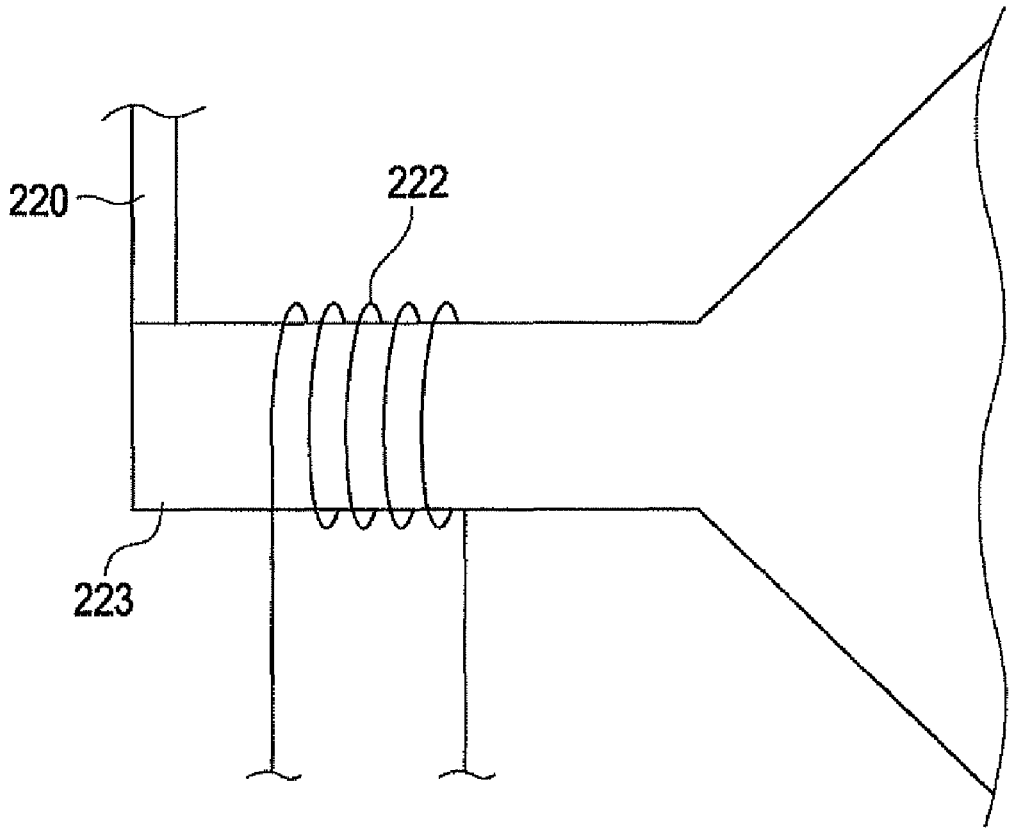
FIG. 5 is a schematic view showing an example of a plasma generating device used for forming the overcoat layer of the electrophotographic photoconductor according to this exemplary embodiment.

Instead of the plasma generating device disposed in the film formation apparatus shown in FIGS. 4A and 4B, the plasma generating device shown in FIG. 5 may be used. FIG. 5 is a schematic side view showing another example of the plasma generating device used in the film formation apparatus shown in FIGS. 4A and 4B. In FIG. 5, 222 denotes a high-frequency coil, 223 denotes a quartz pipe, and 220 denotes a gas-introducing pipe, which is the same as that shown in FIGS. 4A and 4B. This plasma generating device includes the quartz pipe 223 and the high-frequency coil 222 disposed around the peripheral surface of the quartz pipe 223, and the quartz pipe 223 has one end connected to a film formation chamber 210 (not shown in FIG. 5) and another end connected to the gas-introducing pipe 220 for introducing gas to the quartz pipe 223.

In FIGS. 4A and 4B, the shower nozzle 216 that has a rod shape and extends in a direction parallel to the discharge surface is disposed on the discharge surface side of the plate electrode 219. The shower nozzle 216 has one end connected to the gas-introducing pipe 215. The gas-introducing pipe 215 is connected to a second gas supply source (not shown) disposed outside the film formation chamber 210.

The base rotation unit 212 is disposed in the film formation chamber 210. The cylindrical base 214 is mounted on the base rotation unit 212 with the base-supporting member 213 therebetween so that the longitudinal direction of the shower nozzle 216 and the axial direction of the base 214 are parallel to each other. In the film formation, by rotating the base rotation unit 212, the base 214 is rotated in the circumferential direction. Note that, for example, a photoconductor or the like on which film formation has been performed in advance up to the point that a photosensitive layer is formed is used as the base 214.

For example, the overcoat layer is formed as follows.

First, oxygen gas (or oxygen gas diluted with helium (He)), helium gas, and optionally hydrogen ($H_2$) gas are introduced into the high-frequency discharge tube 221 through the gas-introducing pipe 220 while a radio wave having a frequency of 13.56 MHz is supplied to the plate electrode 219 from the high-frequency power supply unit 218. The plasma-spreading portion 217 has a shape that spreads in a radial manner from the discharge surface side of the plate electrode 219 to the outlet 211 side. The gases introduced through the gas-introducing pipe 220 flow from the plate electrode 219 side to the outlet 211 side in the film formation chamber 210. The plate electrode 219 may be covered with an earth shield.

Next, trimethylgallium gas is introduced into the film formation chamber 210 through the gas-introducing pipe 215 and the shower nozzle 216 located downstream from the plate electrode 219 that is an activation unit, whereby a non-single crystal film containing gallium, oxygen, and hydrogen is formed on the surface of the base 214.

For example, a base in which a photosensitive layer has been formed is used as the base 214.

In the case where an organic photoconductor including an organic photosensitive layer is used, the surface temperature of the base 214 during the film formation of the overcoat layer is preferably 150° C. or less, more preferably 100° C. or less, and particularly preferably 30° C. or more and 100° C. or less.

In the case where the surface temperature of the base 214 exceeds 150° C. because of plasma even if the surface temperature is 150° C. or less at the beginning of the film formation, the organic photosensitive layer is sometimes damaged due to heat. Thus, the surface temperature of the base 214 is desirably controlled in consideration of such an effect.

In the case where an amorphous silicon photoconductor is used, the surface temperature of the base 214 during the film formation of the overcoat layer is set to, for example, 30° C. or more and 350° C. or less.

The surface temperature of the base 214 may be controlled with a heating and/or cooling unit (not shown in the drawing) or may be increased through a natural temperature increase during the discharge. When the base 214 is heated, a heater may be disposed outside or inside the base 214. When the base 214 is cooled, a cooling gas or liquid may be circulated inside the base 214.

If an increase in the surface temperature of the base 214 caused by discharge needs to be avoided, it is effective to adjust a gas flow having high energy that hits the surface of the base 214. In this case, the conditions such as gas flow rate, discharge output, and pressure are adjusted such that a desired temperature is achieved.

Instead of trimethylgallium gas, an organic metal compound containing aluminum or a hydride such as diborane may also be used, and these compounds may be used in combination.

For example, if a film containing nitrogen and indium is formed on the base 214 by introducing trimethylindium into the film formation chamber 210 through the gas-introducing pipe 215 and the shower nozzle 216 at the beginning of the formation of the overcoat layer, the film absorbs ultraviolet rays that are generated when the film formation is continuously performed and degrade the photosensitive layer. Thus, the damage to the photosensitive layer caused by the generation of ultraviolet rays during the film formation is suppressed.

In the case where an n-type dopant is doped during the film formation, $SiH_3$ or $SnH_4$ is used in a gaseous state. In the case where a p-type dopant is doped during the film formation, bis(cyclopentadienyl)magnesium, dimethylcalcium, or dimethylstrontium is used in a gaseous state. To dope a dopant element into a surface layer, a publicly known method such as thermal diffusion or ion implantation may be employed.

Specifically, by introducing a gas containing at least one dopant element into the film formation chamber 210 through the gas-introducing pipe 215 and the shower nozzle 216, an overcoat layer of a p- or n-conductivity type is obtained.

In the film formation apparatus described using FIGS. 4A, 4B, and 5, active nitrogen or active hydrogen generated with discharge energy may be independently controlled by disposing plural activating devices or a gas containing both nitrogen atoms and hydrogen atoms such as $NH_3$ may be used. $H_2$ may be further added. Alternatively, the conditions under which active hydrogen is isolated from an organic metal compound may be used.

In such a manner, there are activated carbon atoms, gallium atoms, nitrogen atoms, hydrogen atoms, and the like are present on the surface of the base 214 in a controlled manner. The activated hydrogen atoms eliminate, as a molecule, hydrogen atoms in a hydrocarbon group such as a methyl group or an ethyl group that constitutes an organic metal compound.

Therefore, a hard film (overcoat layer) having three-dimensional bonds is formed.

The plasma generating device of the film formation apparatus shown in FIGS. 4A, 4B, and 5 uses a high-frequency oscillator, but is not limited thereto. For example, a microwave oscillator, an electron cyclotron resonance-type device, or a helicon plasma-type device may be used. The high-frequency oscillator may be of an induction type or a capacitive type.

These devices may be used in combination, or the devices of the same type may be used in combination. The high-frequency oscillator is suitable for suppressing an increase in the surface temperature of the base 214 caused when the irradiation with plasma is performed, but a device configured to suppress the radiation of heat may be disposed.

When two or more different types of plasma generating devices are used, it is desirable that discharges are simultaneously generated at the same pressure. Furthermore, a pressure difference may be made between a region where discharge is generated and a region where film formation is performed (a region where a base is disposed). These devices may be arranged in series in a direction of a gas flow formed from a portion where gas is introduced to a portion where gas is released in the film formation apparatus. Alternatively, these devices may be arranged so as to face the surface of the base where a film is formed.

For example, when two types of plasma generating devices are arranged in series in a direction of the gas flow and the film formation apparatus shown in FIGS. 4A and 4B is taken as an example, the shower nozzle 216 is used as a second plasma generating device that generates discharge in the film formation chamber 210 by using the shower nozzle 216 itself as an electrode. In this case, for example, discharge is generated in the film formation chamber 210 using the shower nozzle 216 as an electrode by applying a high-frequency voltage to the shower nozzle 216 through the gas-introducing pipe 215. Alternatively, instead of using the shower nozzle 216 as an electrode, a cylindrical electrode is disposed between the base 214 and the plate electrode 219 in the film formation chamber 210, and discharge is generated in the film formation chamber 210 using the cylindrical electrode.

When two different types of plasma generating devices are used under the same pressure, for example, when a microwave oscillator and a high-frequency oscillator are used, the excitation energy of excited species is considerably changed, which is effective for controlling the quality of films. The discharge may be generated at a pressure close to atmospheric pressure (70000 Pa or more and 110000 Pa or less). In such a case, He is suitably used as a carrier gas.

In the formation of the overcoat layer or the like, a typical method such as metal-organic chemical vapor deposition or molecular beam epitaxy is used instead of the above-described method. Even when film formation is performed by such a method, it is effective to use active nitrogen and/or active hydrogen and active oxygen in order to decrease temperature. In this case, $N_2$, $NH_3$, $NF_3$, $N_2H_4$, or methylhydrazine is used as a nitrogen raw material. The raw material in a gaseous form is used as it is and the raw material in a liquid form is used through vaporization or by being bubbled with a carrier gas. Oxygen, $H_2O$, CO, $CO_2$, NO, or $N_2O$ is used as an oxygen raw material.

The overcoat layer is formed by disposing, in the film formation chamber 210, the base 214 on which a photosensitive layer is formed and then introducing mixed gases having different compositions.

For example, when high-frequency discharge is performed, the frequency is desirably set in the range of 10 kHz or more and 50 MHz or less to achieve good-quality film formation at low temperature. The output is desirably set in the range of 0.01 W/cm$^2$ or more and 0.2 W/cm$^2$ or less relative to the surface area of the base, though the output depends on the size of the base. The rotation speed of the base is desirably in the range of 0.1 rpm or more and 500 rpm or less.

An example of a function-separated electrophotographic photoconductor has been described. The content of the charge generating material in the single-layer type photosensitive layer 6 (charge generating/charge transporting layer) shown in FIG. 3 is about 10% or more and 85% or less and preferably 20% or more and 50% or less by mass. The content of the charge transporting material is preferably 5% or more and 50% or less by mass. The single-layer type photosensitive layer 6 (charge generating/charge transporting layer) is formed by the same method as that of the charge generating layer 2 or the charge transporting layer 3. The thickness of the single-layer type photosensitive layer 6 (charge generating/charge transporting layer) is preferably about 5 μm or more and 50 μm or less and more preferably 10 μm or more and 40 μm or less.

Process Cartridge and Image Forming Apparatus

Figure 6:
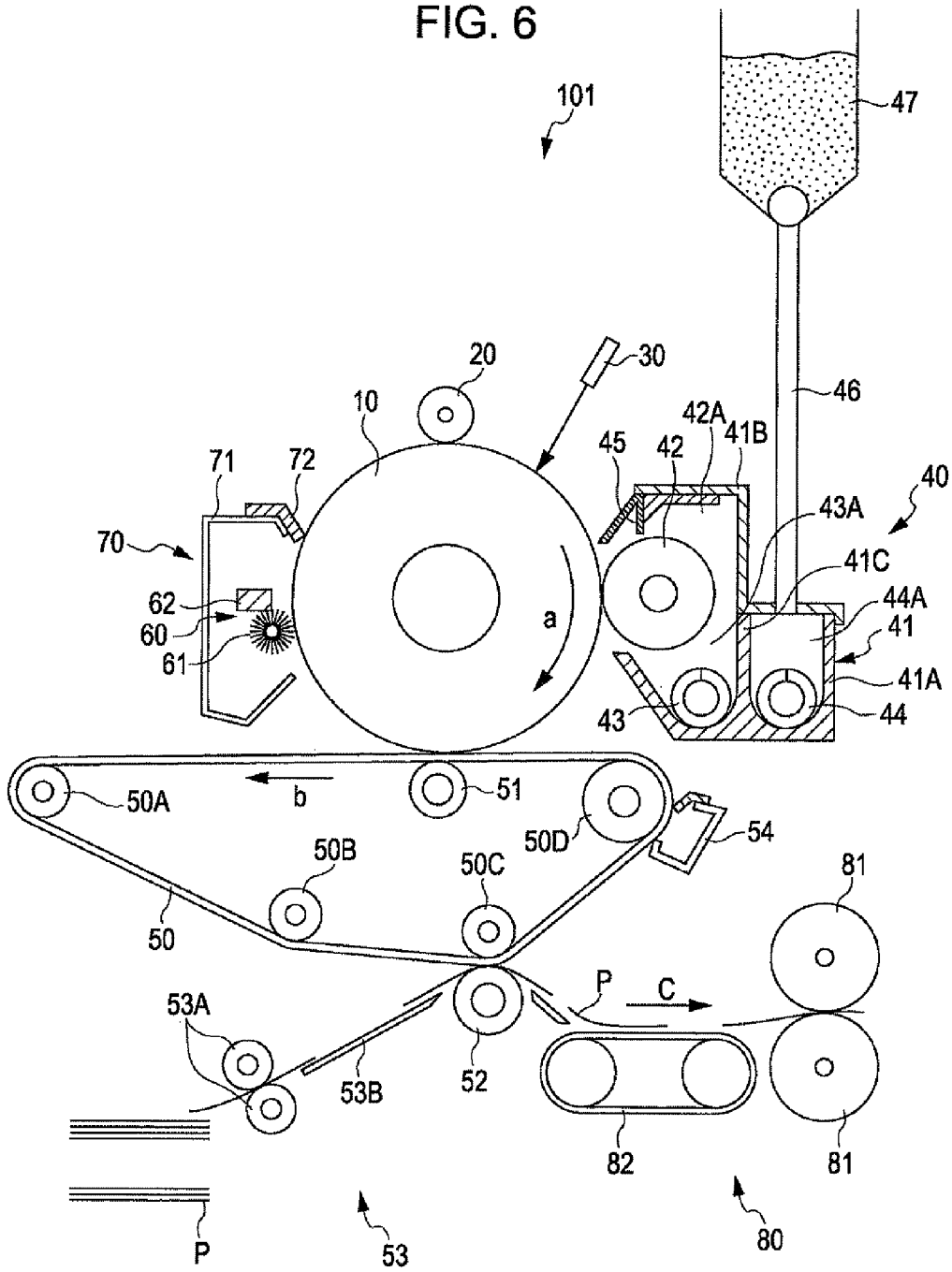
FIG. 6 shows an example of an image forming apparatus according to this exemplary embodiment.

FIG. 6 is a schematic view showing an example of an image forming apparatus according to this exemplary embodiment.

As shown in FIG. 6, an image forming apparatus 101 according to this exemplary embodiment includes an electrophotographic photoconductor 10 (the electrophotographic photoconductor according to the above-described exemplary embodiment), a charging device 20 (an example of a charging unit), an exposure device 30 (an example of an electrostatic latent image forming unit), a developing device 40 (an example of a developing unit), a belt-shaped intermediate transfer body 50, and a cleaning device 70 (an example of a cleaning unit). The electrophotographic photoconductor 10 rotates in a clockwise direction as indicated by an arrow a. The charging device 20 is disposed above the electrophotographic photoconductor 10 so as to face the electrophotographic photoconductor 10 and charges the surface of the electrophotographic photoconductor 10. The exposure device 30 exposes the surface of the electrophotographic photoconductor 10 that has been charged by the charging device 20 to form an electrostatic latent image. The developing device 40 forms a toner image on the surface of the electrophotographic photoconductor 10 by attaching a toner contained in a developer to the electrostatic latent image that has been formed by the exposure device 30. The intermediate transfer body 50 moves in a direction indicated by an arrow b while being in contact with the electrophotographic photoconductor 10 and transfers the toner image formed on the surface of the electrophotographic photoconductor 10. The cleaning device 70 cleans the surface of the electrophotographic photoconductor 10.

The charging device 20, the exposure device 30, the developing device 40, the intermediate transfer body 50, a lubricant-supplying device 60, and the cleaning device 70 are disposed near/on the circumference of the electrophotographic photoconductor 10 in a clockwise direction. In this exemplary embodiment, a configuration in which the lubricant-supplying device 60 is disposed in the cleaning device 70 is described, but the lubricant-supplying device 60 may be disposed separately from the cleaning device 70.

The intermediate transfer body 50 is held by supporting rollers 50A and 50B, a rear roller 50C, and a driving roller 50D, which provide tension to the intermediate transfer body 50 from the inside. The intermediate transfer body 50 is driven with the rotation of the driving roller 50D in a direction indicated by the arrow b. A first transfer device 51 is disposed at a position inside the intermediate transfer body 50 and faces the electrophotographic photoconductor 10. The first transfer device 51 charges the intermediate transfer body 50 in a polarity opposite to the charge polarity of the toner to allow the outer surface of the intermediate transfer body 50 to adsorb the toner on the electrophotographic photoconductor 10. A second transfer device 52 is disposed below the intermediate transfer body 50 so as to face the rear roller 50C. The second transfer device 52 charges recording paper P (an example of recording medium) in a polarity opposite to the charge polarity of the toner to transfer the toner image formed on the intermediate transfer body 50 onto the recording paper P. The first and second transfer devices 51 and 52 for transferring the toner image formed on the electrophotographic photoconductor 10 onto the recording paper P are an example of a transfer unit.

Furthermore, a recording paper supplying device 53 and a fixing device 80 are disposed below the intermediate transfer body 50. The recording paper supplying device 53 supplies the recording paper P to the second transfer device 52. The fixing device 80 transports the recording paper P on which the toner image has been formed by the second transfer device 52 and fixes the toner image.

The recording paper supplying device 53 includes a pair of transporting rollers 53A and a guide slope 53B that guides the recording paper P transported by the transporting rollers 53A toward the second transfer device 52. The fixing device 80 includes fixing rollers 81 that are a pair of heat rollers configured to fix the toner image by applying heat and pressure to the recording paper P on which the toner image has been transferred by the second transfer device 52, and a conveyor 82 that transports the recording paper P toward the fixing rollers 81.

The recording paper P is transported in a direction indicated by an arrow c by the recording paper supplying device 53, the second transfer device 52, and the fixing device 80.

Furthermore, an intermediate-transfer-body cleaning device 54 having a cleaning blade for removing the toner left on the intermediate transfer body 50 after the toner image has been transferred onto the recording paper P by the second transfer device 52 is disposed on the intermediate transfer body 50.

Hereinafter, the constitutional members of the image forming apparatus 101 according to this exemplary embodiment will now be described in detail.

Charging Device

For example, a contact-type charger that uses a conductive charging roller, a charging brush, a charging film, a charging rubber blade, a charging tube, or the like is exemplified as the charging device 20. Moreover, a publicly known charger such as a non-contact-type charger, or a scorotron charger or a corotron charger that uses corona discharge is exemplified as the charging device 20. The contact-type charger is suitable as the charging device 20.

Discharge products are easily generated when a charger with which a voltage obtained by superimposing an alternating current on a direct current is applied is employed. However, in this exemplary embodiment, the attachment and deposition of such discharge products onto the electrophotographic photoconductor 10 are suppressed even if such a charger is employed, and thus the area of unprinted spots is reduced.

Exposure Device

An optical instrument that exposes the surface of the electrophotographic photoconductor 10 to light of a semiconductor laser, a light-emitting diode (LED), a liquid crystal shutter, or the like in an image pattern is exemplified as the exposure device 30. The wavelength of the light source is suitably within the spectral sensitivity range of the electrophotographic photoconductor 10. A near-infrared semiconductor laser having, for example, an oscillation wavelength of about 780 nm is suitably used. However, the wavelength of the light source is not limited thereto, and a laser having an oscillation wavelength of 600 to 700 nm or a blue laser having an oscillation wavelength of 400 nm or more and 450 nm or less may be used. To form a color image, for example, a surface emitting laser source that performs multibeam output is also effective as the exposure device 30.

Developing Device

The developing device 40 is disposed in a development region so as to face the electrophotographic photoconductor 10. The developing device 40 includes a developing container 41 (a body of the developing device) that contains a two-component developer composed of a toner and a carrier and a replenishing-developer container (toner cartridge) 47. The developing container 41 includes a developing container body 41A and a developing container cover 41B that covers the upper end of the developing container body 41A.

The developing container body 41A includes, for example, a developing roller chamber 42A that accommodates a developing roller 42, a first stirring chamber 43A adjacent to the developing roller chamber 42A, and a second stirring chamber 44A adjacent to the first stirring chamber 43A. Furthermore, a layer thickness regulating member 45 for regulating the layer thickness of a developer that is present on the surface of the developing roller 42 is disposed in the developing roller chamber 42A when the developing container cover 41B is attached to the developing container body 41A.

The first stirring chamber 43A and the second stirring chamber 44A are partitioned with a partition wall 41C. Although not shown in the drawing, the first stirring chamber 43A and the second stirring chamber 44A communicate with each other through openings formed at both ends of the partition wall 41C in the longitudinal direction of the partition wall 41C (in the longitudinal direction of the developing device). Thus, the first stirring chamber 43A and the second stirring chamber 44A constitutes a circulatory stirring chamber (43A+44A).

The developing roller 42 is disposed in the developing roller chamber 42A so as to face the electrophotographic photoconductor 10. The developing roller 42 is obtained by disposing a sleeve outside a magnetic roller (stationary magnet, not shown) having magnetism. The developer in the first stirring chamber 43A is adsorbed onto the surface of the developing roller 42 by the magnetic force of the magnetic roller and transported to the development region. In the developing roller 42, the roller shaft is rotatably supported by the developing container body 41A. Herein, the developing roller 42 and the electrophotographic photoconductor 10 each rotate in the same direction. Thus, in the portion where the developing roller 42 and the electrophotographic photoconductor 10 face each other, the developer adsorbed on the surface of the developing roller 42 is transported to the development region from a direction opposite to the rotational direction of the electrophotographic photoconductor 10.

A bias supply (not shown) is connected to the sleeve of the developing roller 42 such that a developing bias is applied (in this exemplary embodiment, a bias obtained by superimposing an alternating-current (AC) component on a direct-current (DC) component is applied so that an alternating electric field is applied to the development region).

A first stirring member (stirring/transporting member) 43 and a second stirring member (stirring/transporting member) 44 that each transport the developer while stirring the developer are disposed in the first stirring chamber 43A and the second stirring chamber 44A, respectively. The first stirring member 43 includes a first rotation shaft that extends in an axial direction of the developing roller 42 and a stirring/transporting blade (protrusion) fixed on a perimeter of the rotation shaft in a spiral form. Similarly, the second stirring member 44 includes a second rotation shaft and a stirring/transporting blade (protrusion). The stirring members are each rotatably supported by the developing container body 41A. The first stirring member 43 and the second stirring member 44 are disposed so that the developers contained in the first stirring chamber 43A and the second stirring chamber 44A are transported in directions opposite to each other through the rotations of the stirring members.

A supply transport path 46 is used for supplying a replenishing developer containing a replenishing toner and a replenishing carrier to the second stirring chamber 44A. The supply transport path 46 has one end connected to one end of the second stirring chamber 44A in the longitudinal direction and another end connected to the replenishing-developer container 47 that contains the replenishing developer.

In such a manner, a replenishing developer is supplied from the replenishing-developer container (toner cartridge) 47 to the developing device 40 (second stirring chamber 44A) through the supply transport path 46.

The developer used in the developing device 40 will now be described. A two-component developer containing a toner and a carrier is employed.

First, a toner will be described. A toner includes, for example, toner particles containing a binder resin, a coloring agent, and optionally other additives such as a release agent; and optionally an external additive.

The average shape factor of the toner particles is preferably 100 and 150 or less, more preferably 105 or more and 145 or less, and more preferably 110 or more and 140 or less. The average shape factor is given as a number average of a shape factor represented by $(ML^2/A)\times(\pi/4)\times100$, where ML is the maximum length of particles and A is a projected area of particles. Furthermore, the volume-average particle size of the toner particles is preferably 3 μm or more and 12 μm or less, more preferably 3.5 μm or more and 10 μm or less, and more preferably 4 μm or more and 9 μm or less.

The toner particles are not particularly limited in terms of the manufacturing method. For example, toner particles are manufactured by a kneading and pulverizing method in which a mixture of a binder resin, a coloring agent, a release agent, and optionally a charge control agent is kneaded, pulverized, and classified; a method in which the shape of the particles obtained by the kneading and pulverizing method is changed by a mechanical impact force or thermal energy; an emulsion aggregation method in which emulsion polymerization is performed on polymerizable monomers of a binder resin, and the resultant dispersion liquid, a coloring agent, a release agent, and optionally a dispersion liquid of a charge control agent are mixed to cause aggregation and heat coalescence; a suspension polymerization method in which polymerizable monomers for obtaining a binder resin, a coloring agent, a release agent, and optionally a solution of a charge control agent are suspended in an aqueous solvent and then polymerization is performed; or a dissolving and suspending method in which a binder resin, a coloring agent, a release agent, and optionally a solution of a charge control agent are suspended in an aqueous solvent to perform granulation.

In addition, there is employed a publicly known method such as a manufacturing method in which the toner particles obtained by the above-described method are used as cores, aggregated particles are made to adhere to the toner particles, and heating and coalescence are performed to provide a core-shell structure. In terms of the control of shape and particle size distribution, a toner is suitably manufactured by a suspension polymerization method, which is performed using an aqueous solvent, an emulsion aggregation method, and a dissolving and suspending method. Among these methods, an emulsion aggregation method is particularly suitable.

The toner is manufactured by mixing the toner particles and the external additive using a Henschel mixer, a V blender, or the like. If the toner particles are manufactured by a wet method, the external additive may be added by a wet method.

Meanwhile, examples of the carrier include iron powder, ferrite powder, nickel powder, or materials obtained by coating the surface of the foregoing with a resin. The mixing ratio between the carrier and the toner is not particularly limited, and is set in the range commonly used. Transfer device Examples of the first transfer device 51 and the second transfer device 52 include contact-type transfer chargers that use a belt, a roller, a film, a rubber blade, or the like and publicly known transfer chargers such as scorotron transfer chargers and corotron transfer chargers that use corona discharge.

A belt-shaped member (intermediate transfer belt) composed of polyimide, polyamide-imide, polycarbonate, polyarylate, polyester, or rubber that each contains a conductive agent is used as the intermediate transfer body 50. The intermediate transfer body may have a cylindrical shape instead of a belt shape.

Cleaning Device

The cleaning device 70 includes a housing 71, a cleaning blade 72 disposed so as to protrude from the housing 71, and the lubricant-supplying device 60 disposed on the upstream side of the cleaning blade 72 in the rotational direction of the electrophotographic photoconductor 10.

The cleaning blade 72 may be supported at the end portion of the housing 71 or may be supported by a supporting member (holder) prepared separately. In this exemplary embodiment, the cleaning blade 72 is supported at the end portion of the housing 71.

First, the cleaning blade 72 will be described.

The cleaning blade 72 is composed of a material such as urethane rubber, silicone rubber, fluorocarbon rubber, propylene rubber, or butadiene rubber. Among these materials, urethane rubber is suitable.

Any urethane rubber used for forming polyurethane is used. For example, urethane rubber is made of a urethane prepolymer composed of a polyol such as polyester polyol (e.g., polyethylene adipate or polycaprolactone) and an isocyanate such as diphenylmethane diisocyanate, and a cross-linking agent such as 1,4-butanediol, trimethylolpropane, ethylene glycol, or a mixture thereof.

Next, the lubricant-supplying device 60 will be described. The lubricant-supplying device 60 is disposed inside the cleaning device 70 and on the upstream side of the cleaning blade 72 in the rotational direction of the electrophotographic photoconductor 10.

The lubricant-supplying device 60 is constituted by, for example, a rotating brush 61 disposed so as to be in contact with the electrophotographic photoconductor 10 and a solid lubricant 62 disposed so as to be in contact with the rotating brush 61. In the lubricant-supplying device 60, the rotating brush 61 is rotated while being in contact with the solid lubricant 62, whereby the lubricant 62 is attached to the rotating brush 61. The attached lubricant 62 is supplied to the surface of the electrophotographic photoconductor 10 and thus a film of the lubricant 62 is formed.

The lubricant-supplying device 60 is not limited to the above-described configuration, and, for example, a rubber roller may be used instead of the rotating brush 61.

An operation of the image forming apparatus 101 according to this exemplary embodiment will now be described. The electrophotographic photoconductor 10 is rotated in a direction indicated by an arrow a and at the same time negatively charged by the charging device 20.

The surface of the electrophotographic photoconductor 10 negatively charged by the charging device 20 is exposed by the exposure device 30, and therefore a latent image is formed on the surface.

When the portion of the electrophotographic photoconductor 10 where the latent image has been formed approaches the developing device 40, a toner is attached to the latent image by the developing device 40 (developing roller 42) and thus a toner image is formed.

When the electrophotographic photoconductor 10 on which the toner image has been formed is further rotated in a direction indicated by an arrow a, the toner image is transferred to the outer surface of the intermediate transfer body 50.

After the toner image is transferred to the intermediate transfer body 50, recording paper P is supplied to the second transfer device 52 by the recording paper supplying device 53 and the toner image transferred to the intermediate transfer body 50 is transferred onto the recording paper P by the second transfer device 52. Thus, the toner image is formed on the recording paper P.

The toner image formed on the recording paper P is fixed by the fixing device 80.

After the toner image is transferred to the intermediate transfer body 50, the lubricant 62 is supplied to the surface of the electrophotographic photoconductor 10 by the lubricant-supplying device 60 and thus a film of the lubricant 62 is formed on the surface of the electrophotographic photoconductor 10. Subsequently, a toner left on the surface and discharge products are removed by the cleaning blade 72 of the cleaning device 70. The electrophotographic photoconductor 10 after a toner left and discharge products have been removed by the cleaning device 70 is charged again by the charging device 20 and exposed by the exposure device 30. Thus, a latent image is formed again.

Figure 7:
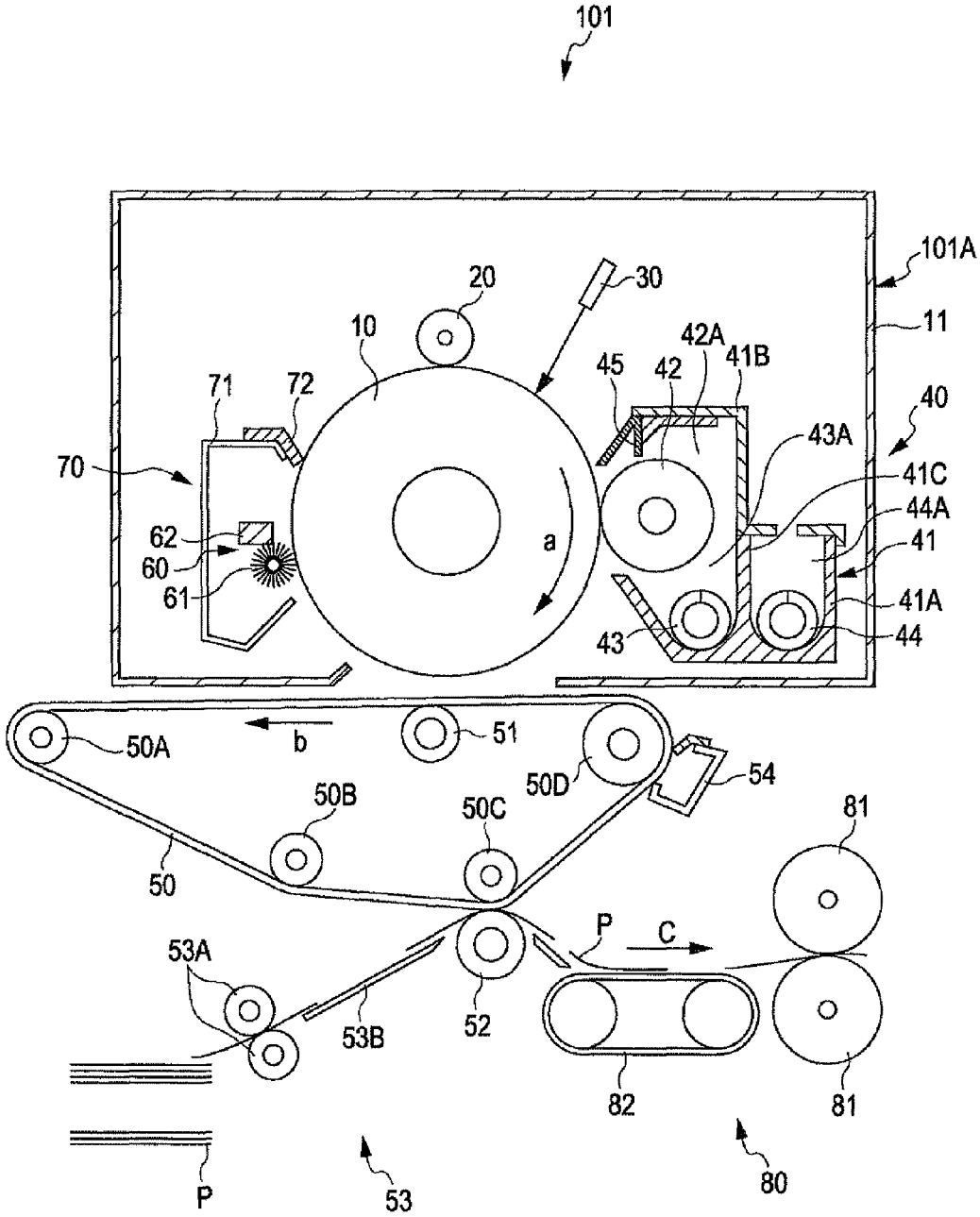
FIG. 7 shows another example of an image forming apparatus according to this exemplary embodiment.

As shown in FIG. 7, the image forming apparatus 101 according to this exemplary embodiment may have a process cartridge 101A obtained by accommodating the electrophotographic photoconductor 10, the charging device 20, the developing device 40, the lubricant-supplying device 60, and the cleaning device 70 in a housing 11 in an integrated manner. The process cartridge 101A accommodates plural members in an integrated manner and is detachably installed in the image forming apparatus 101. In the image forming apparatus 101 shown in FIG. 7, a configuration in which the replenishing-developer container 47 is not disposed in the developing device 40 is described.

The configuration of the process cartridge 101A is not limited thereto. For example, the process cartridge 101A needs only to include at least the electrophotographic photoconductor 10 and may further include at least one selected from the charging device 20, the exposure device 30, the developing device 40, the first transfer device 51, the lubricant-supplying device 60, and the cleaning device 70.

The image forming apparatus 101 according to this exemplary embodiment is not limited to the above-described configurations. For example, a first charge eraser that makes the polarity of the toner left uniform to allow a cleaning brush to easily remove the toner may be disposed at a position on the perimeter of the electrophotographic photoconductor 10, on the downstream side of the first transfer device 51 in the rotational direction of the electrophotographic photoconductor 10, and on the upstream side of the cleaning device 70 in the rotational direction of the electrophotographic photoconductor 10. Alternatively, a second charge eraser that removes the electricity on the surface of the electrophotographic photoconductor 10 may be disposed at a position on the downstream side of the cleaning device 70 in the rotational direction of the electrophotographic photoconductor 10 and on the upstream side of the charging device 20 in the rotational direction of the electrophotographic photoconductor 10.

The image forming apparatus 101 according to this exemplary embodiment is not limited to the above-described configurations, and a publicly known configuration may be employed. For example, a toner image formed on the electrophotographic photoconductor 10 may be directly transferred to recording paper P, or a tandem image forming apparatus may be employed.

EXAMPLES

The present invention will now be specifically described based on Examples, but is not limited to Examples. In Examples, "part" means part by mass.

Example 1

Preparation of Electrophotographic Photoconductor

First, an organic photoconductor obtained by stacking an undercoating layer, a charge generating layer, and a charge transporting layer on an aluminum (Al) base in that order is prepared through the procedure described below.

Formation of Undercoating Layer

A solution obtained by mixing and stirring 20 parts by mass of zirconium compound (trade name: Orgatics ZC540 available from Matsumoto Seiyaku KK), 2.5 parts by mass of silane compound (trade name: A1100 available from Nippon Unicar Company Limited), 10 parts by mass of polyvinyl butyral resin (trade name: S-LEC BM-S available from SEKISUI CHEMICAL Co., Ltd.), and 45 parts by mass of butanol is applied on the surface of the Al base having an outer diameter of 84 mm, and dried by heating at 150° C. for 10 minutes to form an undercoating layer having a thickness of 1.0 μm.

Formation of Charge Generating Layer

Next, a mixture obtained by adding 1 part by mass of chlorogallium phthalocyanine serving as a charge generating material to 1 part by mass of polyvinyl butyral (trade name: S-LEC BM-S available from SEKISUI CHEMICAL Co., Ltd.) and 100 parts by mass of n-butyl acetate is dispersed together with glass beads for one hour using a paint shaker to obtain a dispersion liquid for forming the charge generating layer.

The dispersion liquid is applied on the undercoating layer by dipping, and then dried at 100° C. for 10 minutes to form a charge generating layer having a thickness of 0.15 μm.

Formation of Charge Transporting Layer

Next, 2 parts by mass of the compound represented by Structural formula (1) below and 3 parts by mass of polymer compound (viscosity-average molecular weight: 39000) having a repeating unit represented by Structural formula (2) below are dissolved in 20 parts by mass of chlorobenzene to obtain a coating solution for forming the charge transporting layer.

Structural formula (1)

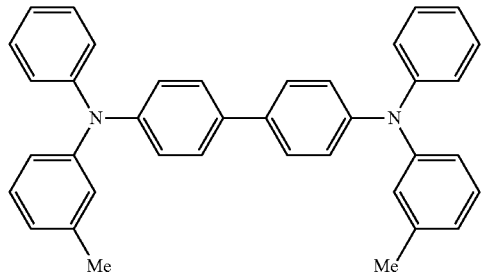

Structural formula (2)

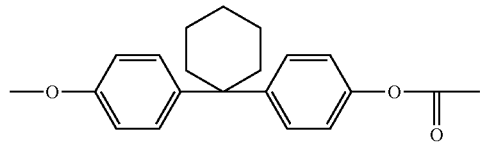

The coating solution is applied on the charge generating layer by dipping, and dried by heating at 110° C. for 40 minutes to form a charge transporting layer having a thickness of 20 μm. Accordingly, an organic photoconductor (hereinafter may be referred to as "uncoated photoconductor (1)") obtained by stacking the undercoating layer, the charge generating layer, and the charge transporting layer on the Al base in that order is obtained.

Formation of Overcoat Layer

An overcoat layer is formed on the surface of the uncoated photoconductor (1) using the film formation apparatus shown in FIGS. 4A and 4B.

A silicon substrate (5 mm×10 mm) for preparing a reference sample is attached to the end portion of the uncoated photoconductor (1) with an adhesive tape. The uncoated photoconductor (1) and the silicon substrate are placed on a base-supporting member 213 in a film formation chamber 210 of the film formation apparatus. The film formation chamber 210 is evacuated through an outlet 211 until the pressure reaches $1\times10^{-2}$ Pa.

Subsequently, hydrogen gas and oxygen gas (40 mol %) diluted with He are supplied at supply rates shown in Table 1 through a gas-introducing pipe 220 to a high-frequency discharge tube 221 in which a plate electrode 219 having a diameter of 50 mm is disposed, while at the same time trimethylgallium gas (about 20 mol %) diluted with hydrogen is supplied at a supply rate shown in Table 1 to a plasma-spreading portion 217 of the film formation chamber 210 through a gas-introducing pipe 215 and a shower nozzle 216. In this state, the reaction pressure in the film formation chamber 210 is adjusted to a pressure (measured with a Baratron vacuum gage) shown in Table 1 by regulating a conductance valve (not shown).

With a high-frequency power supply unit 218 and a matching network (not shown in FIGS. 4A and 4B), the output of a radio wave having a frequency of 13.56 MHz is set to 100 W, matching is performed with a tuner, and discharge is generated from the plate electrode 219. The reflected wave in this case is 0 W. In this state, film formation is performed for a time shown in Table 1 while the uncoated photoconductor (1) is rotated at 100 rpm, whereby an overcoat layer is formed on the surface of the charge transporting layer of the uncoated photoconductor (1).

The trimethylgallium gas diluted with hydrogen is supplied by bubbling trimethylgallium maintained at 0° C. with hydrogen gas serving as a carrier gas.

An electrophotographic photoconductor is obtained through the processes described above.

Analysis and Evaluation of Overcoat Layer

The cleaved section of the reference sample is observed with a scanning electron microscope (SEM) and the thickness of the film (overcoat layer) is measured.

For the film (overcoat layer) formed on the reference sample, the component ratio and the atomic ratio of oxygen to gallium are obtained by composition analysis, and the infrared absorption spectrum is measured to obtain the intensity ratio ($I_{O-H}/I_{Ga-O}$).

The elastic modulus of the film (overcoat layer) formed on the reference sample is also measured.

Table 2 shows the results.

Examples 2 to 6 and Comparative Examples 1 and 2

An overcoat layer is formed on the surface of the charge transporting layer to obtain an electrophotographic photoconductor in the same manner as in Example 1, except that the supply rates of hydrogen gas and oxygen gas (40 mol %) diluted with He, the supply rate of trimethylgallium gas (about 20 mol %) diluted with hydrogen, the pressure in the film formation chamber, the output of a radio wave, and film formation time are changed to values shown in Table 1.

The thus-obtained overcoat layers are also analyzed and evaluated in the same manner as in Example 1. Table 2 shows the results.

Evaluation

The electrophotographic photoconductor obtained in each of Examples and Comparative Examples is installed in an image forming apparatus (DocuCentre Color 500 available from Fuji Xerox Co., Ltd.), and a continuous printing test for 10000 sheets is performed at a temperature of 20° C. and a humidity of 40% RH. After that, 10 image samples with a halftone (30%, 200 dots per inch (dpi)) are printed and the image quality of the tenth image sample is evaluated. The dent state and the crack and flaking state of the overcoat layer of the electrophotographic photoconductor are evaluated. Table 2 shows the results.

The printing test is performed by forming solid images of black, cyan, magenta, and yellow colors each having an area coverage of 5% on A4 paper (P paper available from Fuji Xerox Co., Ltd.).

Dent State of Overcoat Layer

The dent state is measured for 10 fields at a magnification of 450× using a microscope obtained by combining Microscope VHX-100 (available from KEYENCE Corporation) with High magnification zoom lens VH-Z450 and 3D profile measurement unit VHX-S15. The evaluation is performed by counting the number of dents. The evaluation criteria are as follows.

A: There are no dents with film cracking.

B: The number of dents with film cracking is 1 or more and 100 or less per 1 $mm^2$.

C: The number of dents with film cracking is 101 or more per 1 $mm^2$.

Crack and Flaking State of Overcoat Layer

The crack and flaking state is measured for 10 fields at a magnification of 450× using a microscope obtained by combining Microscope VHX-100 (available from KEYENCE Corporation) with High magnification zoom lens VH-Z450 and 3D profile measurement unit VHX-S15. Streaked cracks and flaking caused by the cracks are evaluated. The evaluation criteria are as follows.

A: There are no cracks and flaking at all.

B: There are some cracks, but the cracks are not connected to each other and film flaking is not caused around the cracks.

C: There are some cracks, and the cracks are connected to each other or film flaking is caused around the cracks.

D: The surface layer is completely flaked.

Image Quality

The image quality is evaluated by printing an image sample with a halftone (30%, 200 dpi) and observing the image sample through visual inspection and with an optical microscope. The evaluation criteria are as follows.

A: Both image density and dot reproduction are normal.

B: A decrease in image density or some missing dots and vertical lines are seen, but they are not problematic.

C: A considerable decrease in image density or many vertical lines are seen, and they are problematic.

TABLE 1

| | Gas supply rate (sccm) | | | | | |
|---|---|---|---|---|---|---|
| | First gas supply pipe | Second gas supply pipe | | Pressure in | | |
| | TMG diluted with hydrogen | 40% $O_2$ diluted with He | $H_2$ | film formation chamber (Pa) | Output of radio wave (W) | Film formation time (minute) |
| Ex. 1 | 50 | 30 | 300 | 70 | 500 | 75 |
| Ex. 2 | 50 | 30 | 300 | 70 | 500 | 45 |
| Ex. 3 | 50 | 30 | 300 | 70 | 500 | 105 |
| Ex. 4 | 50 | 30 | 300 | 25 | 500 | 90 |

TABLE 1-continued

| | Gas supply rate (sccm) | | | | | |
|---|---|---|---|---|---|---|
| | First gas supply pipe | Second gas supply pipe | | Pressure in | | |
| | TMG diluted with hydrogen | 40% $O_2$ diluted with He | $H_2$ | film formation chamber (Pa) | Output of radio wave (W) | Film formation time (minute) |
| Ex. 5 | 50 | 30 | 300 | 100 | 500 | 70 |
| Ex. 6 | 50 | 30 | 300 | 70 | 500 | 40 |
| C.E. 1 | 50 | 30 | 300 | 130 | 500 | 45 |
| C.E. 2 | 50 | 30 | 300 | 20 | 500 | 60 |

Ex.: Example
C.E.: Comparative Example

TABLE 2

| | Characteristics of overcoat layer | | | | | | | Evaluation results | | |
|---|---|---|---|---|---|---|---|---|---|---|
| | Component ratio (atom %) | | | Atomic ratio | Intensity ratio | Thickness | Elastic | Dent state of | Crack and flaking state of | Image |
| | Ga | O | H | O/Ga | $(I_{O—H}/I_{Ga—O})$ | (μm) | modulus | overcoat layer | overcoat layer | quality |
| Ex. 1 | 28 | 48 | 20 | 1.71 | 0.25 | 3.6 | 55 | A | A | A |
| Ex. 2 | 28 | 48 | 20 | 1.71 | 0.24 | 2.2 | 55 | A | A | A |
| Ex. 3 | 28 | 48 | 20 | 1.71 | 0.25 | 4.7 | 53 | A | A | A |
| Ex. 4 | 30 | 48 | 18 | 1.6 | 0.1 | 3.5 | 77 | A | C | B |
| Ex. 5 | 26 | 46 | 21 | 1.77 | 0.45 | 3.5 | 33 | A | C | B |
| Ex. 6 | 28 | 48 | 20 | 1.71 | 0.25 | 1.8 | 25 | B | B | B |
| C.E. 1 | 22 | 49 | 21 | 2.23 | 0.52 | 2.3 | 29 | A | D | B |
| C.E. 2 | 32 | 45 | 18 | 1.40 | 0.05 | 2.2 | 92 | C | C | C |

Ex.: Example
C.E.: Comparative Example

It is clear from the results described above that the electrophotographic photoconductors in Examples provide satisfactory results in terms of image quality, the dent state, and the crack and flaking state of the overcoat layer thereof compared with the electrophotographic photoconductors in Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoconductor comprising:
a base;
a photosensitive layer formed on the base; and
an overcoat layer formed on the photosensitive layer,
wherein the overcoat layer includes gallium, oxygen, and hydrogen, and
the intensity ratio $(I_{O-H}/I_{Ga-O})$ of a signal $I_{O-H}$ of an O—H bond to a signal $I_{Ga-O}$ of a Ga—O bond in an infrared absorption spectrum is 0.15 or more and 0.5 or less.

2. The electrophotographic photoconductor according to claim 1, wherein the overcoat layer has a thickness of 2 μm or more.

3. The electrophotographic photoconductor according to claim 1, wherein the atomic ratio of oxygen to gallium in the overcoat layer is more than 1.5 and 2.2 or less.

4. The electrophotographic photoconductor according to claim 3, wherein the atomic ratio of oxygen to gallium in the overcoat layer is more than 1.6 and 2.0 or less.

5. The electrophotographic photoconductor according to claim 1, wherein the intensity ratio $(I_{O-H}/I_{Ga-O})$ of a signal $I_{O-H}$ of an O—H bond to a signal $I_{Ga-O}$ of a Ga—O bond in an infrared absorption spectrum is 0.15 or more and 0.35 or less.

6. The electrophotographic photoconductor according to claim 5, wherein the intensity ratio $(I_{O-H}/I_{Ga-O})$ of a signal $I_{O-H}$ of an O—H bond to a signal $I_{Ga-O}$ of a Ga—O bond in an infrared absorption spectrum is 0.2 or more and 0.3 or less.

7. The electrophotographic photoconductor according to claim 1, wherein the component ratio of gallium contained in the overcoat layer to all constituent elements in the overcoat layer is 15 atom % or more and 50 atom % or less.

8. The electrophotographic photoconductor according to claim 1, wherein the component ratio of hydrogen contained in the overcoat layer to all constituent elements in the overcoat layer is 10 atom % or more and 40 atom % or less.

9. A process cartridge comprising the electrophotographic photoconductor according to claim 1, wherein the process cartridge is detachably installed in an image forming apparatus.

10. The process cartridge according to claim 9, wherein the atomic ratio of oxygen to gallium in the overcoat layer is more than 1.5 and 2.2 or less.

11. The process cartridge according to claim 9, wherein the atomic ratio of oxygen to gallium in the overcoat layer is more than 1.6 and 2.0 or less.

12. The process cartridge according to claim 9, wherein the component ratio of gallium contained in the overcoat layer to all constituent elements in the overcoat layer is 15 atom % or more and 50 atom % or less.

13. An image forming apparatus comprising:

the electrophotographic photoconductor according to claim 1;

a charging unit that charges the electrophotographic photoconductor;

a latent image forming unit that forms a latent image on a surface of the charged electrophotographic photoconductor;

a developing unit that forms a toner image by developing, with a toner, the latent image formed on the surface of the electrophotographic photoconductor; and a transfer unit that transfers the toner image formed on the surface of the electrophotographic photoconductor to a recording medium.

14. The image forming apparatus according to claim 13, wherein the atomic ratio of oxygen to gallium in the overcoat layer is more than 1.5 and 2.2 or less.

15. The image forming apparatus according to claim 13, wherein the atomic ratio of oxygen to gallium in the overcoat layer is more than 1.6 and 2.0 or less.

16. The image forming apparatus according to claim 13, wherein the component ratio of gallium contained in the overcoat layer to all constituent elements in the overcoat layer is 15 atom % or more and 50 atom % or less.

17. An electrophotographic photoconductor comprising:

a base;

a photosensitive layer formed on the base; and an overcoat layer formed on the photosensitive layer, wherein the overcoat layer includes gallium, oxygen, and hydrogen, wherein the intensity ratio ($I_{O\text{-}H}/I_{Ga\text{-}O}$) of a signal $I_{O\text{-}H}$ of an O—H bond to a signal $I_{Ga\text{-}O}$ of a Ga—O bond in an infrared absorption spectrum is 0.15 or more and 0.5 or less, and wherein the atomic ratio of oxygen to gallium in the overcoat layer is more than 1.5 and 2.2 or less.

18. An electrophotographic photoconductor comprising:

a base;

a photosensitive layer formed on the base; and an overcoat layer formed on the photosensitive layer, wherein the overcoat layer includes gallium, oxygen, and hydrogen, wherein the intensity ratio ($I_{O\text{-}H}/I_{Ga\text{-}O}$) of a signal $I_{O\text{-}H}$ of an O—H bond to a signal $I_{Ga\text{-}O}$ of a Ga—O bond in an infrared absorption spectrum is 0.15 or more and 0.5 or less, and wherein the atomic ratio of oxygen to gallium in the overcoat layer is more than 1.6 and 2.2 or less.

* * * * *